US012043994B2

(12) United States Patent
Obrist

(10) Patent No.: US 12,043,994 B2
(45) Date of Patent: Jul. 23, 2024

(54) SAFETY VALVE AND METHOD FOR CONTROLLING A SAFETY VALVE

(71) Applicant: OBLAMATIK AG, Chur (CH)

(72) Inventor: Roland Obrist, Scharans (CH)

(73) Assignee: OBLAMATIK AG, Chur (CH)

( * ) Notice: Subject to any disclaimer, the term of this patent is extended or adjusted under 35 U.S.C. 154(b) by 799 days.

(21) Appl. No.: 15/734,326

(22) PCT Filed: Jun. 4, 2018

(86) PCT No.: PCT/EP2018/064616
§ 371 (c)(1),
(2) Date: Dec. 2, 2020

(87) PCT Pub. No.: WO2019/233544
PCT Pub. Date: Dec. 12, 2019

(65) Prior Publication Data

US 2021/0222408 A1 Jul. 22, 2021

(51) Int. Cl.
*E03C 1/04* (2006.01)
*E03B 7/07* (2006.01)
*E03C 1/05* (2006.01)

(52) U.S. Cl.
CPC ..... *E03C 1/041* (2013.01); *E03B 7/071* (2013.01); *E03C 1/057* (2013.01); *E03C 1/0408* (2013.01)

(58) Field of Classification Search
CPC ..... E03C 1/041; F16K 17/383; G05D 23/14; E03B 7/071
See application file for complete search history.

(56) References Cited

U.S. PATENT DOCUMENTS 5,024,378 A * 6/1991 Bergmann ..... F16K 31/002 236/93 B
2005/0236493 A1* 10/2005 Lin ..... F16K 37/005 236/94
2018/0155906 A1* 6/2018 Sell ..... F16K 17/383

FOREIGN PATENT DOCUMENTS

DE 4423854 A1 1/1996
EP 2466413 A2 6/2012
(Continued)

OTHER PUBLICATIONS

International Preliminary Report on Patentability and Written Opinion for corresponding PCT application No. PCT/EP2018/064616, issued Dec. 8, 2020.
(Continued)

*Primary Examiner* — Elizabeth J Martin
(74) *Attorney, Agent, or Firm* — Notaro, Michalos & Zaccaria P.C.

(57) ABSTRACT

A method for controlling a safety valve for providing a safety valve that has a valve having an inlet and an outlet, the flow rate of the water being variable by changing a valve position, at least one temperature sensor by which the water temperature can be sensed, and at least one control unit by which the data of at least one temperature sensor can be processed and the valve can be actuated defining at least one valve position is disclosed. The method includes the steps of defining a temperature threshold, determining user actuation, setting the at least one valve position by at least partially opening the valve after a user actuation has been determined, sensing the water temperature by the at least one temperature sensor comparing the sensed water temperature with the temperature threshold, and automatically closing the valve if the sensed water temperature lies above the temperature threshold.

8 Claims, 3 Drawing Sheets

(56) References Cited

FOREIGN PATENT DOCUMENTS

| | | | |
|---|---|---|---|
| EP | 3173539 | A2 | 5/2017 |
| WO | 2016177665 | A1 | 11/2016 |

OTHER PUBLICATIONS

International Search Report for corresponding PCT application No. PCT/EP2018/064616, malled Jan. 30, 2019.

* cited by examiner

SAFETY VALVE AND METHOD FOR CONTROLLING A SAFETY VALVE

TECHNICAL FIELD OF THE INVENTION

The present invention relates to a method for controlling a safety valve and a safety valve, in particular for service or drinking water.

DESCRIPTION OF THE RELATED ART

Electronic mixers or thermostats are known from the prior art, which have a cold water and a hot water inlet and at least one mixed water outlet. Such devices also have a temperature sensor with which the mixed water temperature can be detected. The flow rate of the cold water and the hot water in the mixer is determined on the basis of the measured temperature. Mixers of this type are expensive and only function reliably above a certain flow rate.

Such devices do not work reliably with small water flow rates and there is a risk of a user scalding himself. There are water-saving regulations that only allow a maximum water consumption of 0.5 liters per minute. Thermostats can no longer work reliably in this range.

If static mixers are used in which the mixing ratio of cold and hot water is fixed via the corresponding pipe cross-sections, safety cannot be guaranteed directly at a tapping location.

In the case of row tapping locations with premixed water, as is very often found in public facilities, safety can also not be guaranteed directly at the tapping locations.

SUMMARY OF THE INVENTION

One object of the present invention is to provide a method for controlling a safety valve, a safety valve and a safety fitting, with which the above-mentioned disadvantages can be avoided.

This object is achieved by a method with the features of claim 1. Further embodiments of the method, the safety valve and the safety fitting are defined by the features of further claims.

A method according to the invention for controlling a safety valve comprises the steps of:

- providing a safety valve which comprises a valve with an inlet and an outlet, wherein with the valve, the flow rate of the water can be changed by changing a valve position, which valve comprises at least one temperature sensor with which the water temperature can be detected, and which valve comprises at least one control unit, with which the data of the at least one temperature sensor can be processed and with which the valve can be actuated;
- Defining at least one valve position;
- Defining a temperature threshold;
- Detecting a user operation;
- Setting the at least one valve position by at least partially opening the valve after a user operation has been determined;
- Detecting the water temperature with the at least one temperature sensor;
- Comparing the detected water temperature with the temperature threshold;
- Automatic closing of the valve when the detected water temperature is above the temperature threshold.

With such a method, it can be prevent that too much hot water passes through the valve if, for example, the cold water supply is interrupted or a water mixer upstream of the valve is defective and only hot water is available at the inlet of the valve. The temperature threshold can be defined depending on the downstream application of the valve. In order to avoid damage to human tissue from the effects of heat, the temperature of the water flowing through the valve should be below 45 degrees Celsius. With a temperature threshold of 40 degrees Celsius, it can be ensured that no scalding can occur. By integrating the control unit, the valve can function automatically and independently of an overall control system. This reduces the installation and maintenance effort.

In one embodiment, the method further comprises the steps of:

- Defining of at least one interval;
- Waiting during the at least one interval before the valve is automatically opened after the valve has automatically been closed due to the temperature threshold being exceeded.

With these process steps, it can be checked whether the temperature threshold is continuously exceeded and thus the defect is ongoing, or whether it is a temporary malfunction which does not require human intervention.

In one embodiment, the method further comprises the step of:

- Transmitting a signal to a user, to a control center or to a display unit, by means of a transmission unit.

For example, the exceeding of the temperature threshold can be transmitted. The signal can be transmitted by wire or wirelessly. For example, if the temperature threshold is exceeded, it can be displayed locally by means of a light source or a screen. Alternatively, it can be transmitted to a user or to his analysis device, or it can be transmitted to a control center. In all cases it can then be decided whether or not human intervention is required.

In one embodiment, a first valve position and a second valve position are defined and the first valve position is set when the detected water temperature is below the temperature threshold and the second valve position is set when the valve is opened automatically. Below the temperature threshold, as much water may pass through the valve as is necessary for the application downstream of the valve. If the valve is opened automatically after the temperature threshold has been exceeded, in order to check the current water temperature, the valve can be set in such a way that a minimum amount of water for a reliable temperature measurement can pass the valve. The control unit can prevent the valve from opening automatically if, for example, the presence of a user is detected.

In one embodiment, a first interval and a second interval are defined, the second interval being defined relative to the first interval on the basis of the recorded temperature profile. The higher the level of the temperature profile, the longer the subsequent interval will be.

The mentioned embodiments of the method can be carried out in any combination provided they do not contradict one another.

BRIEF DESCRIPTION OF THE DRAWINGS

Embodiments of the current invention are described in more detail in the following with reference to the figures. These are for illustrative purposes only and are not to be construed as limiting. It shows FIG. 1 a schematic representation of a safety valve according to the invention.

DETAILED DESCRIPTION OF THE INVENTION

Figure 1:
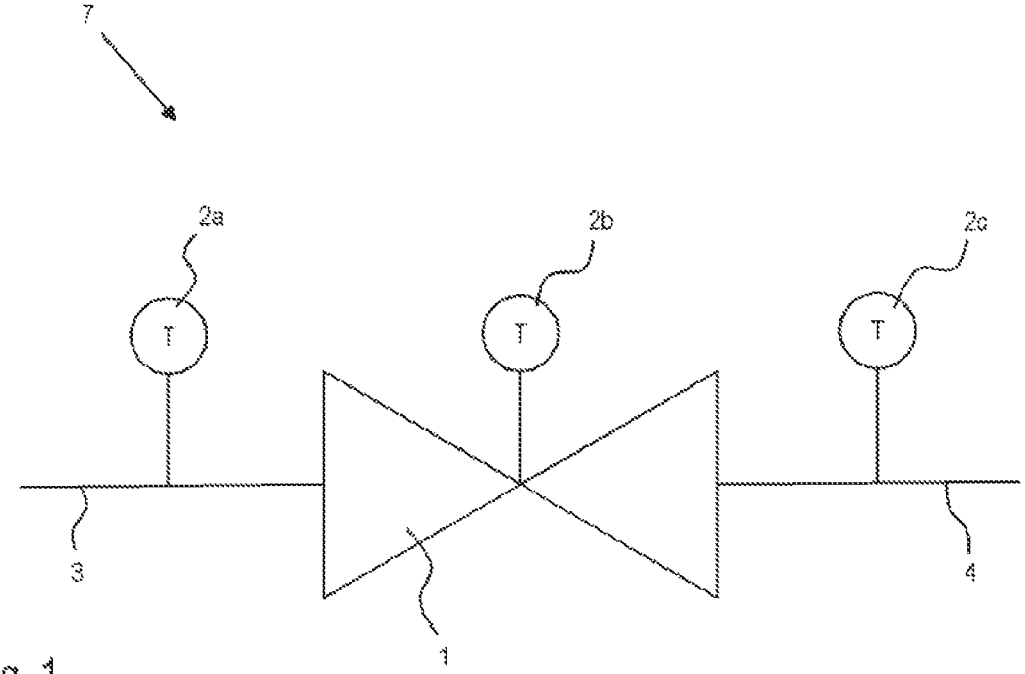

FIG. 1 shows a schematic representation of a safety valve 7 according to the invention with a valve 1, a valve inlet 3, a valve outlet 4 and at least one temperature sensor $\mathbf{2}_a$,$\mathbf{2}_b$,$\mathbf{2}_c$, wherein the temperature sensors can be provided at the inlet 3 and/or in the valve 1 and/or at the outlet 4. The control unit and any transmission unit are not shown.

Figure 2:
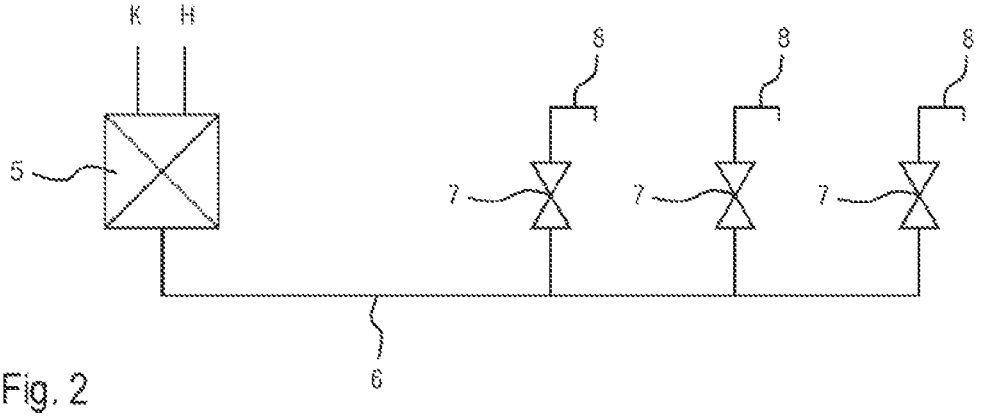
FIG. 2 a schematic representation of row withdrawal locations with valves according to the invention and a mixer.

FIG. 2 shows a schematic representation of row withdrawal locations 8 with valves 7 according to the invention and a mixer 5. The mixer 5 is fed with cold water C and hot water H and delivers mixed warm water to a mixed water line 6. The mixed water line 6 leads the warm water through the valves 7 to the extraction locations.

Figure 3:
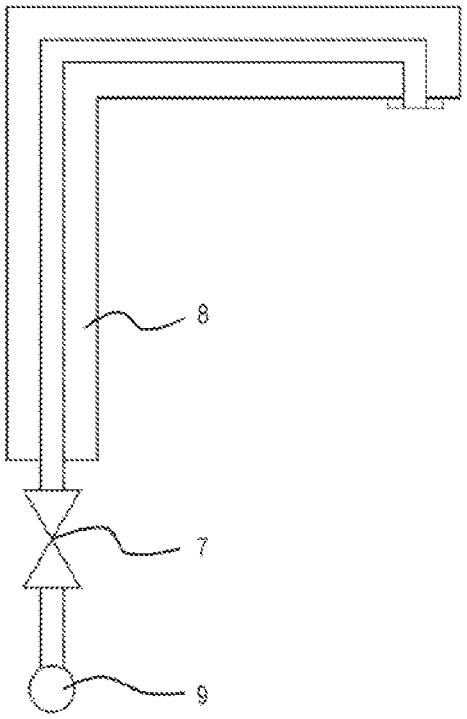
FIG. 3 a schematic representation of a withdrawal fitting with an upstream valve according to the invention.

FIG. 3 shows a schematic representation of a withdrawal fitting 8 with an upstream valve 7 according to the invention. A corner valve 9 is connected upstream of the safety valve 7.

Figure 4:
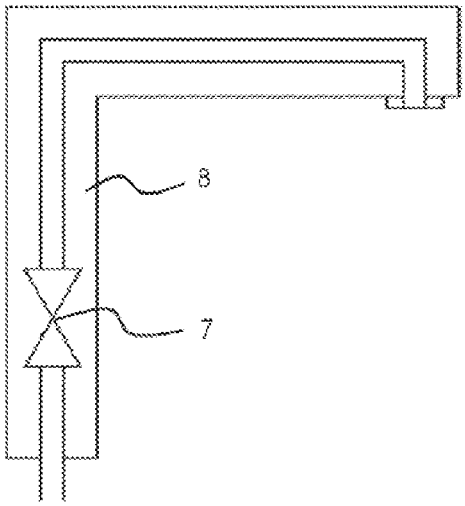
FIG. 4 a schematic representation of a withdrawal fitting with an integrated valve according to the invention.

FIG. 4 shows a schematic representation of a withdrawal fitting 8 with an integrated valve 7 according to the invention.

Figure 5:
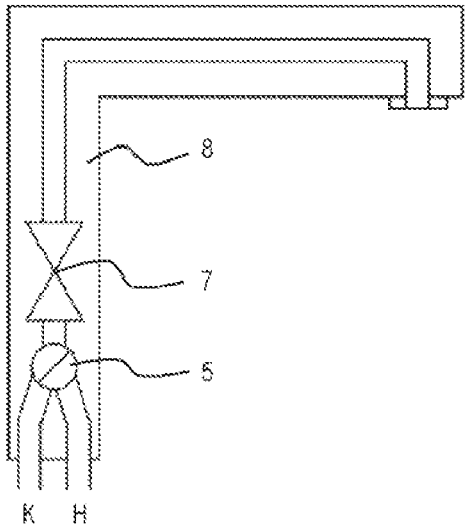
FIG. 5 the extraction fitting according to FIG. 4 with an integrated mixer.

FIG. 5 shows the extraction fitting according to FIG. 4 with an integrated mixer 5, wherein a cold water line C and a hot water line H leading to the mixer 5.

Figure 6:
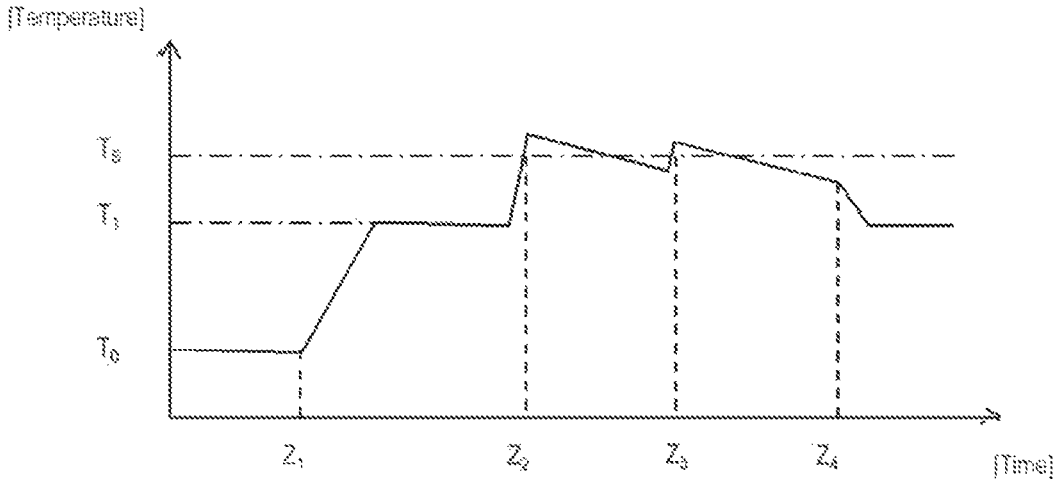
FIG. 6 a schematic temperature profile of the water flowing through the safety valve according to an embodiment of the invention.

FIG. 6 shows a schematic temperature profile of the water flowing through the safety valve 7 according to an embodiment of the invention. The temperature profile shown starts with an initial temperature $T_0$, which is set when the valve has not been operated for a long time. For example, the initial temperature $T_0$ can correspond to the ambient temperature. At a first point in time $Z_1$, a user actuation is detected and a first valve position $V_1$ is set, whereby the measured water temperature rises to the desired mixed temperature $T_1$. The safety valve remains open because the measured temperature is below the temperature threshold $T_S$. Subsequently, the cold water supply fails. At a second point in time $Z_2$, a user actuation is detected and the first valve position $V_1$ is set. Due to the lack of cold water, the temperature determined by the safety valve exceeds the temperature threshold $T_S$, whereupon the valve closes immediately and automatically. Over time, the measured temperature decreases as heat is released into the environment. As long as the measured temperature is above the temperature threshold, the valve is not opened upon a user actuation. If the measured temperature falls below the temperature threshold, as a result of the cooling, the valve is opened upon a user actuation, as is shown in the third point in time $Z_3$. If the temperature rises above the temperature threshold again, the valve is closed again. Before the fourth point in time $Z_4$, the disturbance has been resolved. If the measured temperature is below the temperature threshold upon a user actuation, the valve is opened, and the measured temperature drops to the desired mixed temperature.

Figure 7:
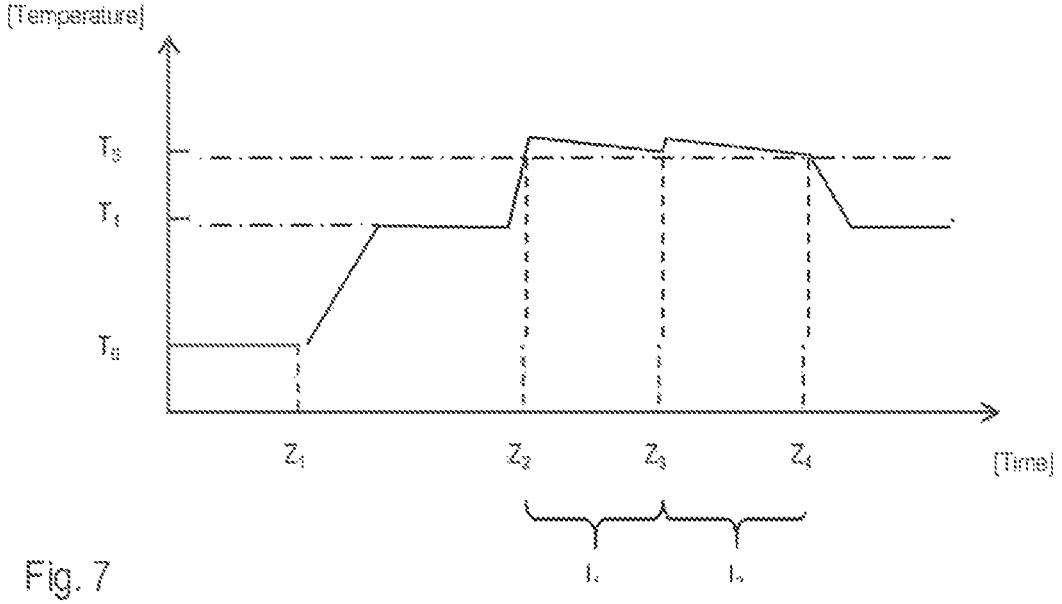
FIG. 7 a schematic temperature profile of the water which flows through the safety valve according to a further embodiment of the invention.

FIG. 7 shows a schematic temperature profile of the water which flows through the safety valve according to a further embodiment of the invention. At the second point in time $Z_2$, the exceeded of the temperature threshold $T_S$ is detected again and the safety valve is closed immediately and automatically. In this embodiment, the valve opens automatically after a first interval $I_1$, but only the amount of water required for a reliable temperature measurement is let through the valve. I.e. the valve is opened less or for a shorter time. If the measured temperature is still above the temperature threshold, the valve closes automatically and the self-opening is repeated after the first interval has elapsed. This continues until the temperature falls below the threshold. In a further embodiment, a second interval $I_2$ is defined based on the temperature profile and relative to the first interval $I_1$. If, for example, after the first interval has elapsed, the measured temperature is still massively too high, the duration of the second interval is defined to be longer than that of the first. I.e. the higher the temperature excess, the longer the subsequent interval gets. Accordingly, the subsequent interval becomes shorter as the temperature excess is smaller.

REFERENCE SIGNS LIST

1 Valve
$\mathbf{2}_{a,b,c}$ Temperature sensor
3 Inlet
4 Outlet
5 Mixer
6 Mixed water line
7 Safety valve
8 Withdrawal location
9 Corner valve
C Cold water
H Hot water
$V_{1,2}$ Valve position
$T_{0,1}$ Temperature
$T_S$ Temperature threshold
$Z_{1,2,3,4}$ Point in time
$I_{1,2}$ Interval

The invention claimed is:

1. A method for controlling a safety valve comprising the steps of:

providing the safety valve (7) comprising:

a valve (1) with an inlet (3) and an outlet (4), wherein a flow rate of the water is changed by the valve (1) by changing a valve position ($V_1$,$V_2$), at least one temperature sensor ($\mathbf{2}_a$,$\mathbf{2}_b$,$\mathbf{2}_c$) with which the water temperature is detected, defining at least one valve position ($V_1$,$V_2$), at which the valve is at least partially opened;

defining a temperature threshold ($T_S$);

determining a user actuation;

setting the at least one valve position ($V_1$,$V_2$) after a user actuation has been determined;

detecting a water temperature (T) with the at least one temperature sensor ($\mathbf{2}_a$,$\mathbf{2}_b$,$\mathbf{2}_c$);

comparing the detected water temperature (T) with the temperature threshold ($T_S$);

automatically closing the valve (1), without user actuation, when the detected water temperature (T) is above the temperature threshold ($T_S$);

defining a first interval ($I_1$) and a second interval ($I_2$), wherein the second interval ($I_2$) being defined relative to the first interval ($I_1$) based on a temperature profile; and waiting during the first interval ($I_1$) or the second interval ($I_2$) before the valve (1) is opened automatically, after the valve (1) has been closed automatically due to the temperature threshold ($T_S$) being exceeded.

2. The method according to claim 1, wherein a first valve position ($V_1$) and a second valve position ($V_2$) are defined and wherein the first valve position ($V_1$) is set when the detected water temperature (T) is below the temperature threshold ($T_S$) and wherein the second valve position ($V_2$) is set when the valve (1) is opened automatically.

3. A safety valve (7) comprising:

a valve (1) with an inlet (3) and an outlet (4), wherein the flow rate of the water is changed by the valve (1) by changing the valve position ($V_1$,$V_2$), at least one temperature sensor ($\mathbf{2}_a$,$\mathbf{2}_b$,$\mathbf{2}_c$) with which a water temperature is detected, and wherein the safety valve (7) is configured to:

define at least one valve position ($V_1$,$V_2$), at which the valve (1) is at least partially opened;

define a temperature threshold ($T_S$);

determine a user actuation;

set the at least one valve position ($V_1$,$V_2$) after a user actuation has been determined;

detect a water temperature (T) with the at least one temperature sensor ($\mathbf{2}_a$,$\mathbf{2}_b$,$\mathbf{2}_c$);

compare the detected water temperature (T) with the temperature threshold ($T_S$);

automatically close the valve (1), without user actuation, when the detected water temperature (T) is above the temperature threshold ($T_S$);

define a first interval ($I_1$) and a second interval ($I_2$), wherein the second interval ($I_2$) being defined relative to the first interval ($I_1$) based on a temperature profile; and wait during the least first interval ($I_1$) or the second interval ($I_2$) before the valve (1) is opened automatically, after the valve (1) has been closed automatically due to the temperature threshold ($T_S$) being exceeded.

4. The safety valve (7) according to claim 3, wherein the temperature sensor (2*a*,2*b*,2*c*) is arranged in the region of the inlet (3), the outlet (4) or the valve (1).

5. The safety valve (7) according to claim 3, wherein the valve (1) comprises a valve from the group comprising solenoid valve, powered cartridge, spindle valve, proportional valve, and ball valve.

6. A safety fitting comprising:

the safety valve (7) according to claim 3, and an extraction location (8).

7. The safety fitting according to claim 6, wherein the safety valve (7) is arranged before the extraction location (8) or in it.

8. The safety fitting according to claim 6, wherein the extraction location (8) comprises an extraction location from the group which comprises basin fitting, kitchen fitting, shower fitting and bath fitting.

* * * * *